US005735200A

United States Patent [19]

Tomei et al.

[11] Patent Number: 5,735,200

[45] Date of Patent: Apr. 7, 1998

[54] STAMPING PRESS LOADER

[75] Inventors: Carl Tomei, Clarkston; Donley Townsend, Detroit; John Jackson, Troy, all of Mich.

[73] Assignee: Chrysler Corporation, Auburn Hills, Mich.

[21] Appl. No.: 674,039

[22] Filed: Jul. 1, 1996

[51] Int. Cl.[6] ..... B30B 15/30

[52] U.S. Cl. ..... 100/215; 414/752; 901/22; 901/40

[58] Field of Search ..... 100/207, 215; 414/752; 901/22, 40

[56] References Cited

U.S. PATENT DOCUMENTS

| | | | |
|---|---|---|---|
| 3,912,317 | 10/1975 | Ohnaka | 901/40 |
| 4,037,730 | 7/1977 | Fetzer et al. | 100/215 |
| 4,439,092 | 3/1984 | Ajisaka | 414/752 |
| 4,487,409 | 12/1984 | Orii | 414/752 |
| 4,784,562 | 11/1988 | Kishi et al. | 100/215 |
| 5,556,505 | 9/1996 | Hill | 901/40 |

FOREIGN PATENT DOCUMENTS

| | | | |
|---|---|---|---|
| 2143490 | 2/1985 | United Kingdom | 100/215 |
| 92/10360 | 6/1992 | WIPO | 100/215 |

*Primary Examiner*—Stephen F. Gerrity
*Attorney, Agent, or Firm*—Edward A. Craig

[57] ABSTRACT

Apparatus for loading sheet material into a stamping press comprising a tool releasably mounted on the outer end of a boom. The tool has grippers for picking up and releasing sheet material. The boom is advanced lengthwise into the press where the grippers release the sheet material for stamping. The boom can be swung laterally to a tool-charting position where the tool can be changed easily and safely.

7 Claims, 4 Drawing Sheets

STAMPING PRESS LOADER

FIELD OF INVENTION

This invention relates generally to press loaders and more particularly to apparatus for loading sheet material into a stamping press.

BACKGROUND AND SUMMARY OF THE INVENTION

Stamping press loaders typically have a boom provided with a tool for gripping sheet material. The boom moves into the press where the tool releases the sheet material which is then stamped by the press dies. From time to time, the tool has to be changed and this in the past has required the operator to walk across a flat slippery press bed while carrying replacement tooling.

In accordance with the present invention, the boom is so mounted that it is capable of being moved to one side where the operator can make the tool change conveniently and safely and without having to walk across the press bed.

More particularly, and in a specific embodiment of the invention described herein, the inner end of the boom is mounted for swinging movement from a loading position to a tool-changing position. When in its loading position, the boom is advanced in the direction of its length to place the tool inside the press where the sheet material is released. When retracted, the boom can be swung approximately 90° to its tool-changing position where a tool change can be made conveniently and safely.

One object of this invention is to provide a stamping press loader having the foregoing features and capabilities.

Another object is to provide a stamping press loader which is composed of a relatively few simple parts, is rugged and durable in use, and is capable of being inexpensively made and easily operated.

These and other objects, features and advantages of the invention will become more apparent as the following description proceeds, especially when considered with the accompanying drawings.

DETAILED DESCRIPTION OF THE PREFERRED EMBODIMENT

Figure 1:
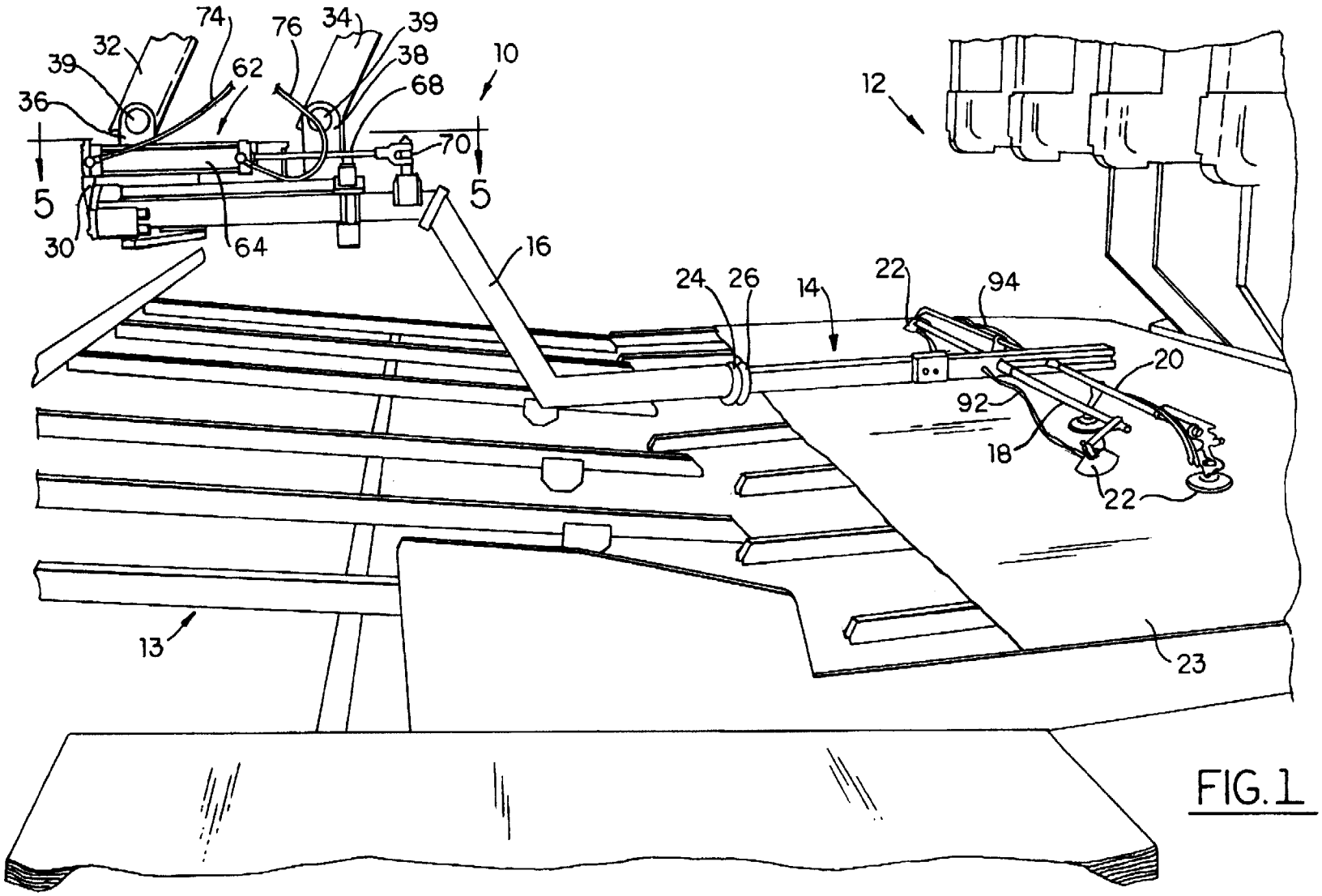
FIG. 1 is a perspective view showing a stamping press loader constructed in accordance with the invention.
Figure 2:
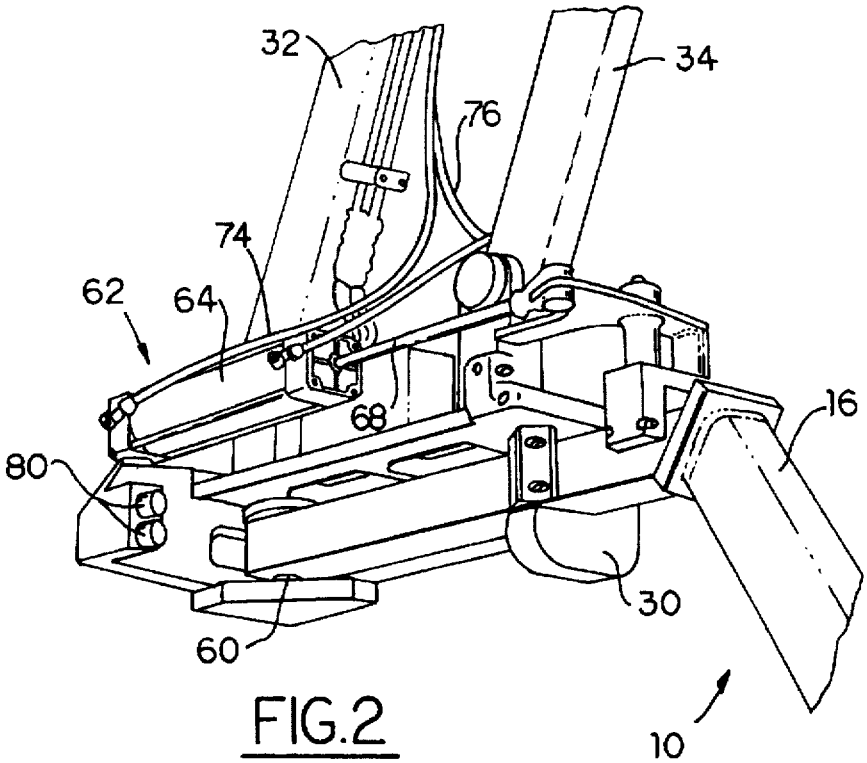
FIGS. 2, 3 and 4 are perspective views of portions of the stamping press loader shown in FIG. 1.
Figure 3:
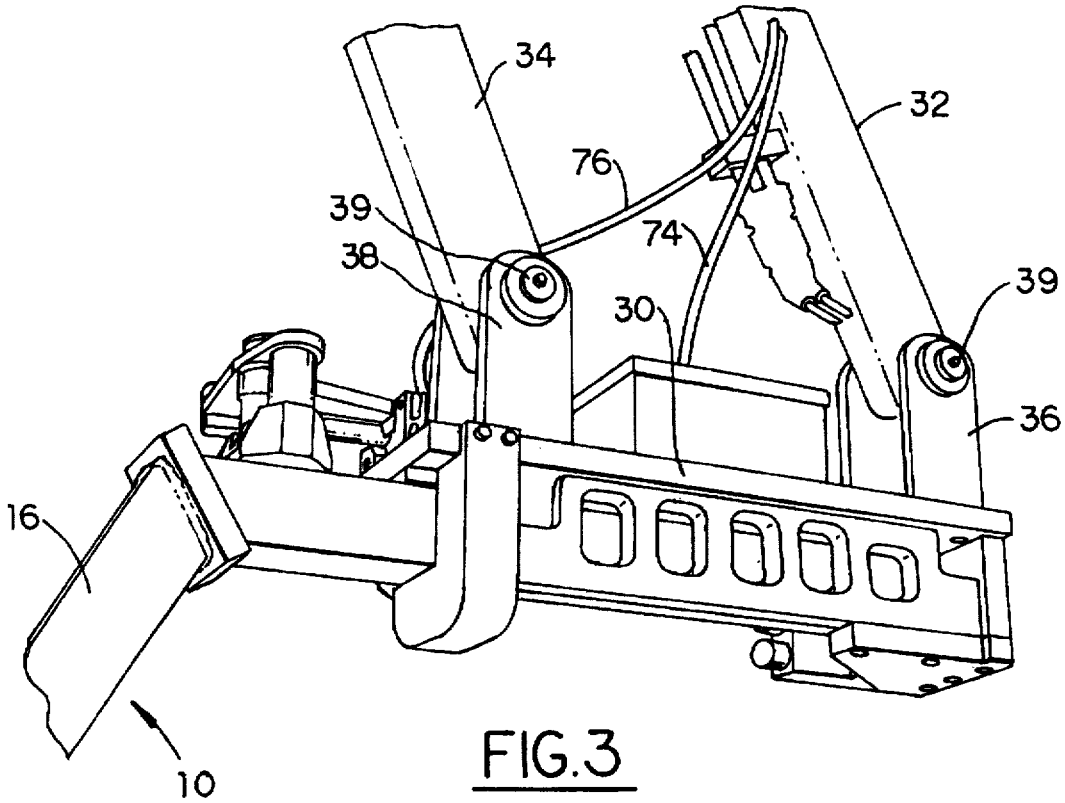
Figure 4:
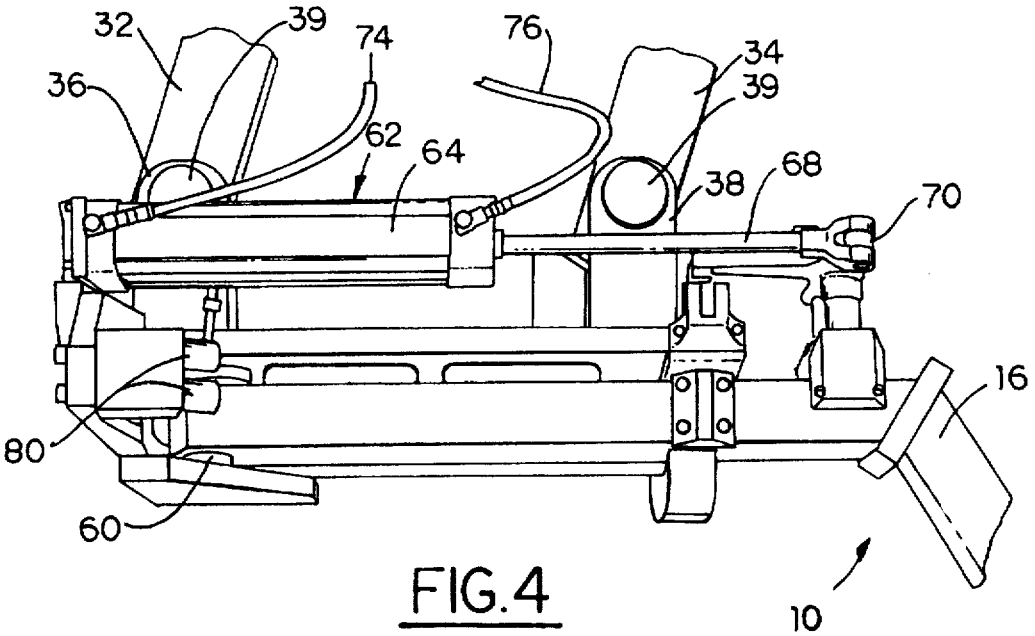

Referring now more particularly to the drawings, a stamping press loader 10 is shown in FIG. 1, at one side of a stamping press 12. The loader is shown above a table 13 for supporting sheet material.

The loader 10 comprises a tool 14 releasably mounted on the outer tool-supporting end of an elongated boom 16. The tool 14 is an elongated member forming an extension of the boom. Cross bars 18 and 20 are mounted on the tool near its outer end and have grippers in the form of suction cups 22. The suction cups are for gripping sheet material, such as the sheet metal panel 23, which is to be formed in the press.

The outer end of the boom 16 and the inner end of the tool have flanges 24 and 26 which are connected together by fasteners 28 to form a releasable coupling.

The boom is mounted on a carriage 30. The carriage is suspended from the generally upright, parallel arms 32 and 34. Specifically, the carriage has brackets 36 and 38 pivoted by parallel, horizontal pivot pins 39 to the lower ends of the arms.

The upper ends of the arms 32 and 34 are pivoted by parallel, horizontal pivot pins 40 to a slide 42 mounted on vertical rails 44 for vertical sliding movement. At an intermediate point in their length, the arms 32 and 34 are pivoted at 46 to a shuttle 48 slidable horizontally on rails 50 of a frame 51 by a screw 52 which is rotated by a drive motor 54 and threadedly engages the shuttle 48. Rotation of the screw moves the shuttle horizontally causing the arms 32 and 34 to move the carriage 30 horizontally toward and away from the press. The frame 51 is mounted on the vertical rails 44 and moved vertically by a screw 56 rotated by a drive motor 58. The motors 54 and 58 may be operated simultaneously so that movement of the boom 16 is substantially horizontal rather than in a downward arc as would occur if the motor 58 were not operated.

Figures 5, 7:
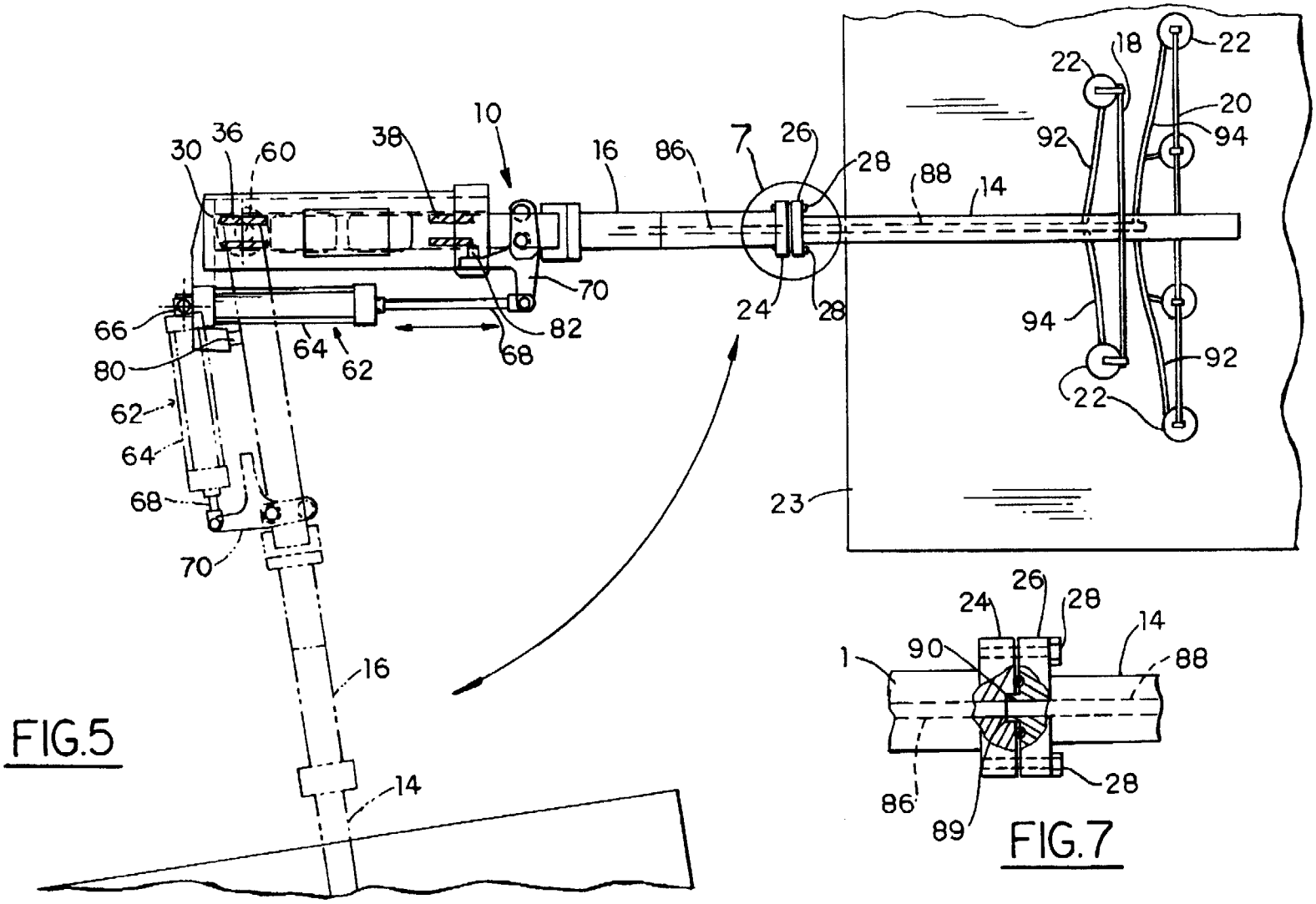
FIG. 5 is a top plan view partly in section and taken on the line 5—5 in FIG. 1, showing the boom in the loading position in solid lines and in the tool-changing position in broken lines.
FIG. 7 is an enlarged fragmentary view of the structure within the circle 7 in FIG. 5 showing the releasable connection between the boom and the tool on which the sheet material grippers are mounted.

The inner end of the boom 16 is pivoted to the carriage 30 for lateral swinging movement about the axis of the vertical pivot pin 60. The boom is swingable horizontally from a loading position shown in solid lines in FIG. 5 to a tool-changing position shown in broken lines. In the loading position, the boom extends toward the press in the path or line of movement of the carriage. In the tool-changing position, the boom is swung approximately 90° from its loading position.

The boom is swung about the pivot 60 between its loading and tool-changing positions by a piston-cylinder assembly 62. The piston-cylinder assembly 62 comprises an elongated cylinder 64 having the head end pivoted to a bracket 66 on the carriage. A piston rod 68 extends from a piston (not shown) in the cylinder and is pivoted to a bracket 70 mounted on the carriage. Extension of the piston rod swings the boom to the solid line position of FIG. 5 and retraction of the piston rod swings the boom to the broken line position. Hydraulic fluid lines 74 and 76 leading to opposite ends of the cylinder are provided to move the piston therein in one direction or the other. Suitable valving (not shown) is provided for controlling the direction of fluid to and from the opposite ends of the cylinder.

Stops 80 and 82 mounted on the carriage 30 are provided to contact the boom 16 and the bracket 70 to prevent movement of the boom 16 beyond the loading and tool-changing positions.

A vacuum line leads to the suction cups 22. The vacuum line comprises a conduit 86 in the boom 16 and a conduit 88 in the tool 14, with male and female members 89 and 90 forming a releasable coupling between the conduits 86 and 88 when the flanges 24 and 26 on the adjacent ends of the boom and tool are connected together. The conduit 88 in tool 14 communicates with the suction cups through tubes 92 and 94. Suitable vacuum-producing means (not shown) are provided for applying suction to the cups through the vacuum line to grip and hold the panel 23, and for removing the suction to release the panel.

Figure 6:
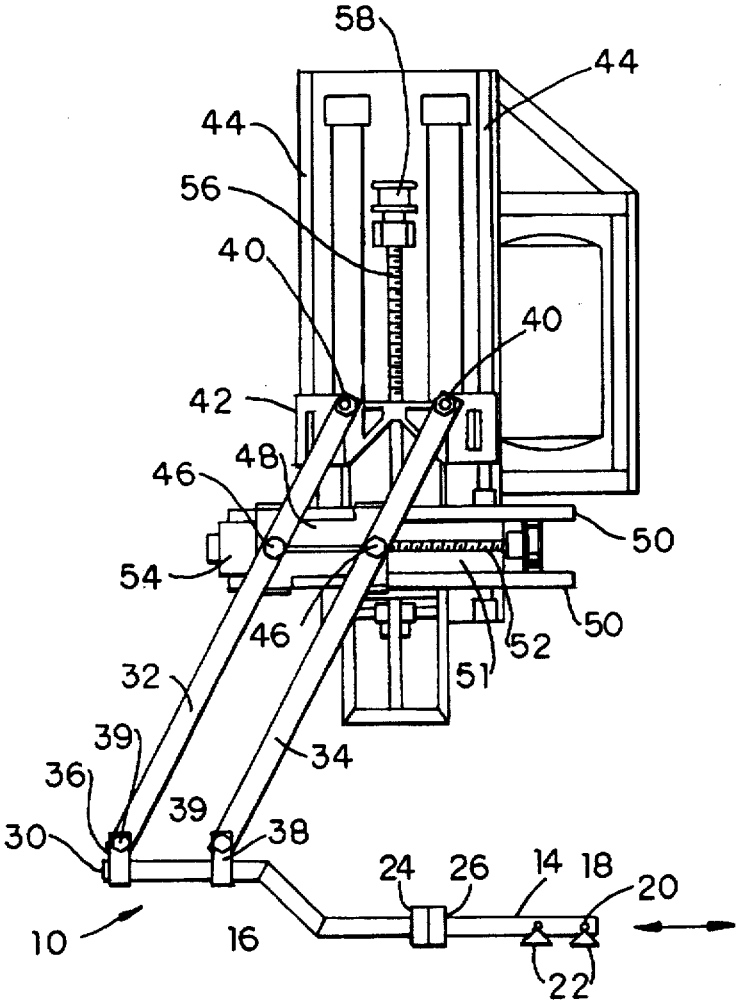
FIG. 6 is a side elevational view of the loader, including the apparatus for swinging the loader toward and away from the stamping press.

The loader is moved in the direction of the arrows in FIG. 6 to pick up a sheet metal panel 23 on the table 13 by means of suction cups 22 and carry it to the press 12 where it is released for stamping. When it is desired to change a tool, the piston-cylinder assembly 62 is operated to swing the boom to the broken line position of FIG. 5, where the fasteners 28 are released, and the existing tool is replaced. The operator does not have to walk across the slippery press bed to change the tool.

What is claimed is:

1. Apparatus for loading sheet material into a stamping press comprising an elongated boom having an inner end and an outer tool-supporting end, a tool having grippers for picking up and releasing sheet material, means releasably attaching the tool to the tool-supporting end of the boom, a boom-supporting carriage adjacent to the stamping press, means for moving said carriage toward and away from the stamping press from a retracted position to an advanced position, and means mounting the inner end of said boom on said carriage for lateral swinging movement from a loading position in which said boom extends toward the stamping press and, when the carriage is in the advanced position, the tool is disposed in the stamping press, to a tool-changing position extending at an acute angle to said loading position.

2. Apparatus as defined in claim 1, and further including stops for preventing swinging movement of said boom beyond said loading and tool-changing positions.

3. Apparatus as defined in claim 1, wherein said grippers comprise suction cups.

4. Apparatus as defined in claim 3, and further including a vacuum line leading to said suction cups, said vacuum line comprising vacuum conduits carded by said boom and said tool, and a releasable coupling for interconnecting said conduits.

5. Apparatus as defined in claim 1, wherein said carriage is moved by said moving means along a generally horizontal path, said boom when in its loading position extends in general alignment with said path, the tool-changing position is at approximately 90° to said loading position, and further including stops for preventing swinging movement of said boom beyond said loading and tool-changing positions.

6. Apparatus as defined in claim 5, wherein said grippers comprise suction cups, and further including a vacuum line leading to said suction cups, said vacuum line comprising vacuum conduits carried by said boom and said tool, and a releasable coupling interconnecting said conduits.

7. Apparatus as defined in claim 6, wherein said means releasably attaching the tool to the tool-supporting end of the boom comprises flanges on said tool and the tool-supporting end of the boom, fasteners releasably connecting said flanges, and interengaged male and female members on said respective flanges comprising the releasable coupling interconnecting said conduits.

* * * * *